United States Patent [19]

Abrahamsen

[11] Patent Number: 4,531,254

[45] Date of Patent: Jul. 30, 1985

[54] SCRAPER FOR GUTTERS

[76] Inventor: Christian T. Abrahamsen, P.O. Box 2065, Elmwood Park, Ill. 60635

[21] Appl. No.: 514,528

[22] Filed: Jul. 18, 1983

[51] Int. Cl.[3] ..... A47L 25/00

[52] U.S. Cl. ..... 15/236 R; 30/169

[58] Field of Search ..... 15/104.04, 236 R, 236 A; 30/169

[56] References Cited

U.S. PATENT DOCUMENTS

| | | | |
|---|---|---|---|
| 3,551,937 | 1/1971 | Nelson | 15/236 R |
| 3,571,838 | 3/1971 | Stasechke | 15/236 R |
| 3,858,267 | 1/1975 | Swannie | 15/236 R |

*Primary Examiner*—Edward L. Roberts
*Attorney, Agent, or Firm*—Eugene F. Friedman; Leonard S. Knox

[57] ABSTRACT

A tool for removing paint from sheet metal gutters having a central ogee portion connected to two straight, vertical portions. The scraper includes a flat blade having an edge whose contour matches very closely the shape of the gutter. In particular, it approximates the exterior configuration of the gutter on a transverse cross-sectional view. The contour, however, has a slightly greater height than that displayed by the gutter; this allows the horizontal extensions of the blade to pass over the upper and lower edges of the gutter to effectuate contact with the gutter's vertical face. Cleaning the upper and lower horizontal surfaces of the gutter then merely requires shifting the blade downward to clean the former and upward for the latter. An extended handle on the blade allows its use by a workman located at some distance from the gutter. To further facilitate its use at a distance from the gutter, the handle may pivot relative to the blade.

4 Claims, 3 Drawing Figures

SCRAPER FOR GUTTERS

BACKGROUND

Repainting eaves or gutters for buildings frequently entails removing the generally loose fragments of the prior coating. Typically, the preparation requires scraping flakes of paint from the metal underneath.

As a further hindrance, the eaves generally lie beyond an arm's reach of a person standing on the ground. Thus, a ladder or scaffold must be resorted to, which adds to the cost of the operation.

SUMMARY

Sheet metal eaves, or gutters, in most cases, display a standard transverse cross section. A blade having an active edge portion nearly congruent with the gutter's shape effectuates an acceptable scraping. The standard shape includes an ogee curve position connected, at either end, to a straight, vertical section. Horizontal surfaces then connect to the vertical portions. The horizontal portion of the eave may also receive adequate cleaning by providing two horizontal scraping portions on the blade. The distance between these two horizontal blade portions slightly exceeds the separation of the eaves' horizontal surfaces. Moving the blade upward scrapes the lower horizontal surface of the eaves. Shifting it downward allows it to act on the gutter's upper horizontal portion. The range of movement thus allowed enables the blade portion to reach and act vertically upon substantially all of the eaves.

A slight canting of the tool may help assure contact with the eave over its entire vertical portions. This allows simultaneous cleaning of the eaves' entire vertical surface. Similar considerations pertain to the scraping performed on other portions of the eaves' surface.

The scraper includes a substantially flat and rigid plate. The active edge of the plate displays a contour having a first straight vertical position. An intermediate ogee-curve portion connects to the first vertical portion. A second vertical straight edge portion forms a continuation of the other end of the ogee-curve portion. The contour of the blade displays substantial congruence with the external configuration of a gutter.

Optionally, a handle, secured at a convenient location on the blade, allows for the facile manipulation of the tool. If desired, a thumb screw or wing nut and bolt couples the scraping blade and handle and enables an angular adjustment of the latter with respect to the former.

DETAILED DESCRIPTION

The scraper shown in the figures dislodges paint and the like from a metallic base surface such as aluminum or galvanized iron. Weathered exterior paint seldom requires extensive effort to remove the paint flakes from the underlying surface. A rigid, flat sheet metal blade

10, with sharp edges, can dislodge the flaking paint at an acceptable rate.

Most metal gutters follow a standard cross sectional pattern. This configuration includes an ogee curve; a flat flange at the top; and a flat floor terminating in a horizontal attaching flange at the rear.

The active scraper displays a generally corresponding contour edge. This contour includes a horizontal straight run 10*a*, an ogee-curved portion 10*b*, and a horizontal straight floor 10*c* with vertical straight edges between the ogee curve and the horizontal runs 10*a* and 10*b*.

Figure 1:
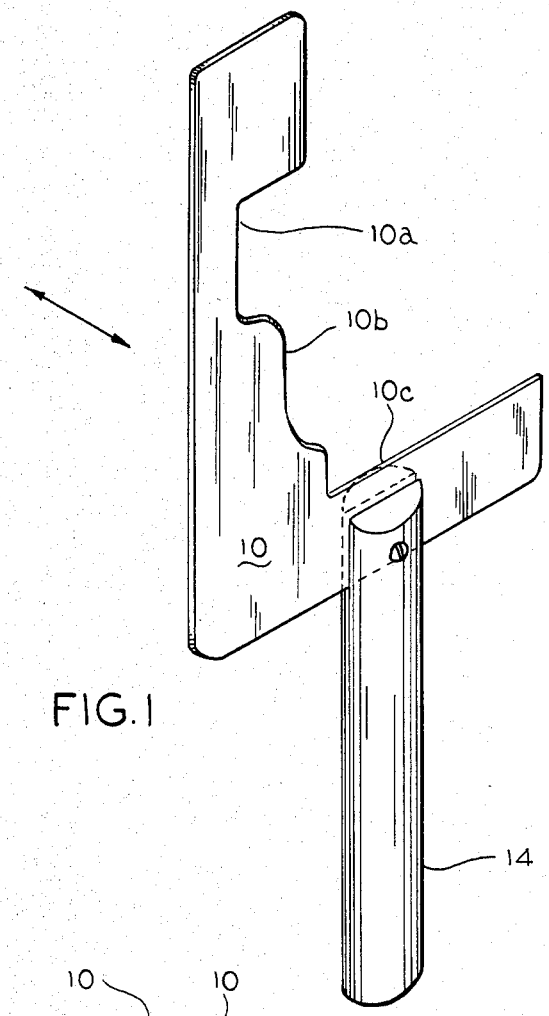
FIG. 1 gives an isometric view of a scraper and handle having an edge contour congruent to an eave's exterior surface.
Figure 2:
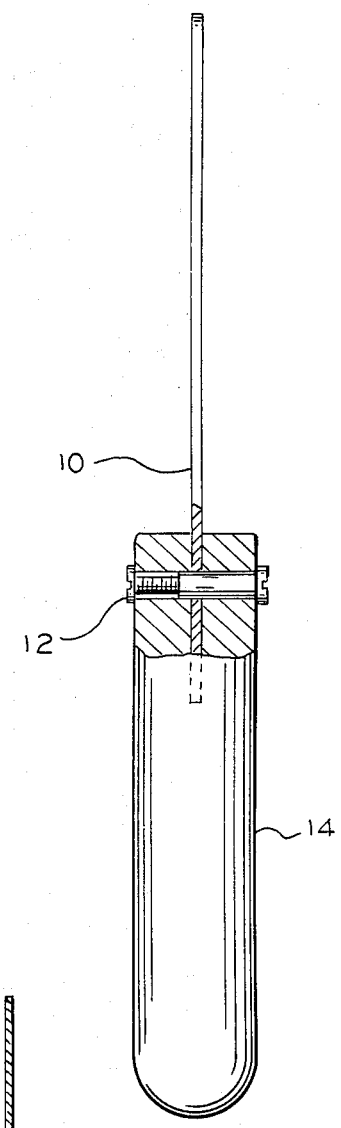
FIG. 2 provides a side elevation, partly in section, of the scraper of FIG. 1.
Figure 3:
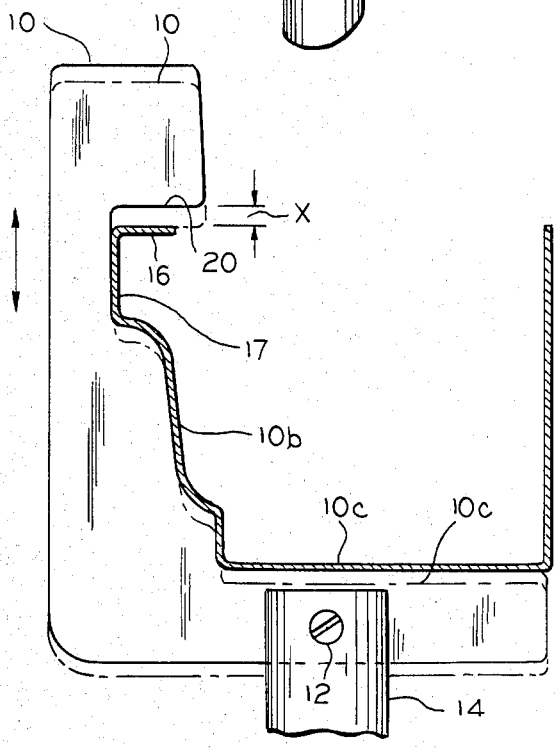
FIG. 3 display is a cross section taken transversely of an eave undergoing scraping.

The respective matching parts of the eave and the scraper do not need absolute congruency. Canting the blade 10 about a horizontal or vertical axis may achieve suitable contact of the scraper edge and eave surface, as shown in FIG. 3.

The screw 12 attaches the handle 14 to the blade 10. It also permits adjusting the relative angle between the two components. Readjusting the angle of the handle 14 may permit the most efficient removal of the paint. Normally, the trough lies with its edge 10*c* on the horizontal. However, if the eave happens to list from that position, the handle 14 can hold the blade 10 at an angle of attack that accommodates the misalignment.

Additional versatility results from spacing the eaves' edge 20 a small distance X from the edge 16 of the scraper. Allowing this extra space may permit full access to the surfaces 20, 17, and 16. Moving the blade 10 upward, as shown in solid llines in FIG. 3, causes the horizontal blade portion 10*c* to contact the gutter's bottom surface. Similarly, a downward motion of the blade 10 brings its upper straight edge 20 into contact with the top 16 of the eaves. A similar advantage may result between the other surfaces of the blade 10 and the eaves.

Accordingly, what is claimed is:

1. A device for scraping the exterior surface of a gutter, said exterior surface having a transverse configuration of (1) a gutter ogee-curve portion, (2) a first gutter straight line extending vertically upwardly from one end of said ogee-curve portion, a second gutter straight line extending vertically downward from the other end of said gutter ogee-curve portion, said device comprising a substantially flat and rigid blade with an edge having a contour including (a) a scraper ogee-curve portion, (b) a first scraper straight line extending from one end of said scraper ogee-curve portion, and (c) a second scraper straight line extending from the other end of said scraper ogee-curve portion and parallel to said first scraper straight line, said contour being substantially congruent with said configuration of said exterior surface.

2. The device of claim 1 wherein said first scraper line of said contour is longer than said first gutter straight line, the difference in length between said first gutter line and said first scraper straight line enabling vertical shifting of said blade, while in contact with said gutter, relative to said gutter.

3. A device for scraping the exterior surface of a sheet metal roof gutter, said gutter having a central ogee portion, a vertically extending first flat portion forming an upward continuation of one end of said ogee portion, a second flat portion forming a downward continuation of the other end of said ogee portion, first and second horizontal portions extending rearwardly from said first and second vertical flat portions, respectively, said device comprising:

(A) a substantially flat and rigid blade having an edge with a contour with a central ogee portion, first and second straight portions at opposite ends of said ogee portion, and third and fourth straight portions at the ends of and perpendicular to said first and second straight portions, respectively; and (B) holding means, coupled to said blade, for enabling manipulation of said blade.

4. The combination in accordance with claim 3 in which said holding means includes a handle and connecting means, coupled to said handle and to said blade, for retaining said handle to said blade in a fixed position at any one of a plurality of relative angles between said blade and said handle.

* * * * *